US011361608B2

(12) United States Patent
Enomoto

(10) Patent No.: US 11,361,608 B2
(45) Date of Patent: Jun. 14, 2022

(54) COIN SEPARATING AND DETECTING DEVICE

(71) Applicant: Asahi Seiko Co., Ltd., Tokyo (JP)

(72) Inventor: Minoru Enomoto, Saitama (JP)

(73) Assignee: Asahi Seiko Co., Ltd.

( * ) Notice: Subject to any disclaimer, the term of this patent is extended or adjusted under 35 U.S.C. 154(b) by 296 days.

(21) Appl. No.: 16/706,435

(22) Filed: Dec. 6, 2019

(65) Prior Publication Data

US 2020/0242873 A1 Jul. 30, 2020

(30) Foreign Application Priority Data

Jan. 28, 2019 (JP) ..... JP2019-012611

(51) Int. Cl.

| | |
|---|---|
| ***G07D 3/12*** | (2006.01) |
| *G07D 5/00* | (2006.01) |
| *G07D 5/02* | (2006.01) |

(52) U.S. Cl.

CPC ..... *G07D 3/121* (2013.01); *G07D 3/128* (2013.01); *G07D 5/005* (2013.01); *G07D 5/02* (2013.01);

(Continued)

(58) Field of Classification Search

CPC ..... G07D 3/121; G07D 3/128; G07D 5/005; G07D 5/02; G07D 9/008; G07D 3/14; G07D 1/00; G07D 3/00

See application file for complete search history.

(56) References Cited

U.S. PATENT DOCUMENTS 5,022,889 A 6/1991 Ristvedt et al.
5,688,166 A * 11/1997 Chen ..... G07D 9/008 453/49

(Continued)

FOREIGN PATENT DOCUMENTS

| | | |
|---|---|---|
| EP | 1617384 | 3/2007 |
| EP | 1679667 | 9/2008 |

(Continued)

OTHER PUBLICATIONS

Enomoto, Minoru; Non-Final Office Action for U.S. Appl. No. 16/706,423, filed Dec. 6, 2019, dated Jun. 22, 2021, 20 pgs.

(Continued)

*Primary Examiner* — Jeffrey A Shapiro
(74) *Attorney, Agent, or Firm* — Taylor English Duma LLP

(57) ABSTRACT

A coin separating and detecting device includes: a separating and feeding rotating body disposed inclinedly and configured to receive and separate coins; a coin separating and feeding device configured to push out the coins that have been separated; and a coin detecting device configured to receive the coins from the coin separating and feeding device, the coin detecting device including: a detecting rotating body configured to move the coins; and a sensor configured to acquire physical information on the coins, wherein the separating and feeding rotating body and the detecting rotating body are positioned adjacent each other in a horizontal direction; and wherein the detecting rotating body is configured to receive the coins; hold the coins; deliver the coins onto the detecting portion introduction guide; and push the coins forward along the detecting portion introduction guide.

5 Claims, 12 Drawing Sheets

(52) U.S. Cl.
CPC ..... *G07D 2201/00* (2013.01); *G07D 2205/00* (2013.01)

(56) References Cited

U.S. PATENT DOCUMENTS

| | | | | |
|---|---|---|---|---|
| 7,377,846 | B2 | 5/2008 | Umeda | |
| 7,470,174 | B2 | 12/2008 | Umeda et al. | |
| 8,967,361 | B2 | 3/2015 | Martin | |
| 9,022,841 | B2 | 5/2015 | Martin | |
| 9,105,140 | B2 | 8/2015 | Enomoto | |
| 2006/0113161 | A1* | 6/2006 | Umeda | G07D 9/008 194/302 |
| 2006/0223428 | A1 | 10/2006 | Fujii | |
| 2007/0062783 | A1 | 3/2007 | Hill | |
| 2007/0087676 | A1* | 4/2007 | Enomoto | G07D 9/008 453/13 |
| 2009/0029638 | A1* | 1/2009 | Enomoto | G07D 9/008 453/57 |
| 2010/0041325 | A1* | 2/2010 | Takeuchi | G07F 9/04 453/3 |
| 2012/0145741 | A1* | 6/2012 | Enomoto | G07D 9/00 221/277 |
| 2014/0170948 | A1 | 6/2014 | Enomoto | |
| 2016/0171809 | A1* | 6/2016 | Ohtomo | G07D 5/02 194/317 |
| 2020/0219352 | A1 | 7/2020 | Mennie et al. | |
| 2020/0242873 | A1* | 7/2020 | Enomoto | G07D 9/008 |
| 2020/0242874 | A1 | 7/2020 | Enomoto | |

FOREIGN PATENT DOCUMENTS

| | | |
|---|---|---|
| EP | 1777661 | 12/2009 |
| JP | 4665087 | 4/2011 |
| JP | 4784806 | 10/2011 |
| JP | 4997374 | 8/2012 |
| JP | 2014134972 | 7/2014 |
| JP | 5945773 | 7/2016 |

OTHER PUBLICATIONS

Enomoto, Minoru; Applicant-Initiated Interview Summary for U.S. Appl. No. 16/706,423, filed Dec. 6, 2019, dated Sep. 17, 2021, 7 pgs.

Enomoto, Minoru; Notice of Allowance for U.S. Appl. No. 16/706,423, filed Dec. 6, 2019, dated Feb. 14, 2022, 9 pgs.

* cited by examiner (A)

(B)

(A)

(B)

(C)

COIN SEPARATING AND DETECTING DEVICE

BACKGROUND OF THE INVENTION

Field of the Invention

The present invention relates to a coin separating and detecting device in which coins of a plurality of denominations and having different diameters are separated one by one and, subsequently, information on inspection of coins can correctly be acquired in a detecting device as the next process.

Particularly, the present invention relates to a coin separating and detecting device in which even small-sized coins of a plurality of denominations and having different diameters are separated one by one and, subsequently, information on inspection of coins can correctly be acquired in a detecting device as the next process.

Note that the term "coin" used in the present description is a concept including coins or tokens etc. having a certain thickness and diameter in a disk-shape, as well as coins in a deformed octagonal shape such as British twenty or fifty pence coins.

Description of the Background Art

As the first related art, a device for sorting coins according to coin denominations that has been filed by the present applicant has been known, in which coins are separated one by one by a separating and feeding device and thereafter fed to a denomination identification device which is disposed at a diagonally upper location, and the denomination of coins is identified at the denomination identification device by detecting physical properties of the coins by a sensor in a step in which coins are moved by a rotating body diagonally upwards along a linear guide, thereafter, during a step in which the lower peripheral surface of the coins is guided by a guide rail and coins are transported on a passage being aligned in one line by a transport device which supports the coins of a plurality of denominations at the lower surface of the coins on a slide plate which is inclined to the horizon and moves the coins in one direction, and the coins are sorted to each of selecting ports according to coin denomination of a first selecting portion which is formed at the slide plate, wherein the guide rail is configured to include a movable guide rail capable of being selectively positioned in a guiding position for guiding the coins and a non-guiding position for not guiding the coins, the movable guide rail is disposed facing a selecting port of the first selecting portion below in the direction orthogonal to the extending direction of the passage in order to configure a selecting port of a second selecting portion, the selecting ports of the first selecting portion and the second selecting portion are selectively opened (Japanese Patent No. 4997374, FIGS. 2 to 13, paragraphs [0006] to [0007]).

As the second related art, a coin dispensing device has been known, including an alignment device that aligns coins in one line that enter an entry port;

a selecting passage for coins that are aligned in one line by the alignment device;

a deposit transport device that moves the aligned coins within the selecting passage;

a selecting portion that selects the coins that are transported by the deposit transport device according to their denomination;

a plurality of hoppers that retain the coins selected by the selecting portion in a random state for each denomination, pay coins out one by one and are disposed in two lines;

an expenditure transport device that is disposed between the two lines of the hoppers; and a dispensing port for coins that are transported by the expenditure transport device, each of the plurality of hoppers including a rotary disk which has a through hole through which coins are able to fall downward one by one and which is rotatable; and a base which holds the coins fallen out of the through hole in a movable manner and guides the coins pushed out by the rotation of the rotary disk into a predetermined direction, wherein the selecting portion for each denomination shifts the coins on a slide base disposed in a horizontal state to select the coins according to the denomination respectively that have fallen into a selecting portion which is opened at a predetermined timing (Japanese Patent No. 4665087, FIGS. 2 to 10, paragraphs [0006] and [0007]).

SUMMARY OF THE INVENTION

Problems to be Solved by the Invention

In the first related art, coins are separated one by one by the separating and feeding device and, thereafter, fed to the denomination identification device which is disposed at a diagonally upper location. Since the height inevitably increases in the vertical directions of the entire coin separating and detecting device, there has been the need for a coin separating and detecting device having a small height. Since physical properties are acquired by the sensor in the denomination identification device while moving coins by the rotating body, it is advantageous that inspection and maintenance are easy and must be carried out after long intervals.

In the second related art, it is advantageous that the height can be decreased in vertical directions since coins that are aligned in one line by the alignment device and transported in a horizontal state are detected by the denomination identification device, and, thereafter, the coins are transported in a horizontal state on the slide plate which is horizontally installed. Meanwhile, since the alignment device and the denomination identification device for coins are disposed in one line, the dimension of the device in the transport direction becomes larger. Furthermore, if coins are linearly moved a relatively long distance, a belt or chain for linear movements needs to be used. However, in case of using an electromagnetic sensor, metal cannot be used, which is why it is general for transport to use a linearly travelling belt made of an elastic body. In case of using a belt, adjustment etc. of the tension due to expansion of the belt is necessary and frequent inspection and maintenance must be done, so that there has been the need for a coin separating and detecting device for which inspection and maintenance are easy and must be carried out after long intervals.

In order to solve the above-described problem, modification of the first related art is conceivable. Namely, as illustrated in FIG. 12, it is conceivable to provide a denomination identification device 20 directly lateral to the horizontal direction parallel to the separating and feeding device 10. Note that the chain line shows a denomination identification device 20*p* which is disposed in a position according to conventional art. In this case, coins C are separated one by one and retained in a retaining concave portion 14 which is formed on an upper surface of a rotary table 12 constituting the separating and feeding device 10, and coins C are pushed out to the side of the denomination identification device 20 by a pushing body 16 at a predetermined timing. The coins C that have been pushed out fall onto a push lever 22 which rotates at the denomination identification device 20. The working edge 24 of a conventional push lever 22 is in a linear shape, therefore, the coins keep vibrating in some cases even after being guided to the guide rail 30 for sensors 28 because the coins C that have fallen spring up and collide against the guide wall 26 in the periphery. Thus, it is disadvantageous that accurate detection by the sensor 28 is impossible.

The object of the present invention is to provide a coin separating and detecting device having decreased height and enabling accurate detection by a sensor.

Means to Solve a Problem

In order to achieve the above object, the first aspect according to claim 1 has the following feature.

A coin separating and detecting device in which coins are received one by one in a separating concave portion which is formed on an upper surface of a separating and feeding rotating body disposed inclinedly and the coins are separated, and, thereafter, the coins that have been separated are fed to a coin detecting device from a coin separating and feeding device configured to push out the separated coins from the separating concave portion by a moving body which is movable in the radial direction of the separating and feeding rotating body, and the coin detecting device includes a detecting rotating body that moves the coins that have been fed along a detecting portion introduction guide, and a sensor that acquires physical information on the coins in the step in which the coins are moved along a detection guide following the detecting portion introduction guide, wherein the separating and feeding rotating body and the detecting rotating body are aligned laterally in parallel in the horizontal direction, and the detecting rotating body receives the coins in the step in which the coins fed from the separating and feeding rotating body fall downwards and holds the coins, and, thereafter, delivers the coins onto the detecting portion introduction guide, and afterwards pushes the coins forward along the detecting portion introduction guide.

The second aspect of the present invention according to claim 2 has the following feature.

The coin separating and detecting device according to the first aspect wherein the detecting rotating body is formed with an inward reception peripheral edge side portion on a peripheral edge side to hold coins fed from the separating and feeding rotating body on the detecting rotating body by the inward reception peripheral edge side portion until the detecting rotating body arrives at a predetermined positional relationship.

The third aspect of the present invention according to claim 3 has the following feature.

The coin separating and detecting device according to the first or second aspect wherein a falling guide body is disposed between the separating and feeding rotating body and the detecting rotating body.

The fourth aspect of the present invention according to claim 4 has the following feature.

The coin separating and detecting device according to the third aspect wherein the falling guide body is a slope which descends forward from a side of the separating and feeding rotating body toward a side of the detecting rotating body.

The fifth aspect of the present invention according to claim 5 has the following feature.

The coin separating and detecting device according to any one of the first to the fourth aspects wherein the detecting portion introduction guide includes an arc portion that is curved and extends downward away from the separating and feeding rotating body, and a detection guide extending linearly upward from the arc portion and away from the separating and feeding rotating body, wherein the arc portion and the detection guide are connected by a temporary retaining portion which is in an arc-shape and positioned in a location lower than the arc portion and the detection guide.

Effects of the Invention

According to the first aspect, the separating and feeding rotating body of the coin separating and feeding device and the detecting rotating body of the coin detecting device are inclined with respect to the horizon and aligned laterally in parallel in the horizontal direction. Thus, these devices have the height determined by the diameter and the inclination angle of the separating and feeding rotating body and the detecting rotating body and are configured with reduced height. The coins received and separated one by one in a separating concave portion which is formed on an upper surface of the separating and feeding rotating body disposed inclinedly are pushed out to a detecting device from the separating concave portion by a moving body which is movable in the radial direction of the separating and feeding rotating body. The coins that have been pushed out fall onto a coin reception 184*r* of the detecting rotating body. Since the coins that have fallen onto the coin reception 184*r* are movable between a reception center side portion 184*rc* and a reception peripheral edge side portion 184*rp*, vibrations of the coins C are suppressed. Large-sized coins LC are held by the coin reception 184*r* and a detecting portion introduction guide and cannot vibrate. Even in case of jumping as a reaction of having fallen-down onto the coin reception 184*r*, small-sized coins SC are delivered onto an arc-shaped detecting portion introduction guide by falling downward by their own weight after being held at the reception peripheral edge side portion 184*rp*. The fall-down of these coins C takes place in a state in which a coin handling arm is inclined at a certain grade, in other words, in a state of small distance to the detecting portion introduction guide. Thereby, since the distance of fall-down of the coins when delivered to the detecting portion introduction guide is small, vibrations are minute even if they are generated. Even if minute vibrations are generated, coins reach a static state at a temporary retaining portion by their own weight between the detecting portion introduction guide and the detection guide. Subsequently, with respect to the coins that are moved along the detection guide while being pushed by a coin pushing portion of the detecting rotating body, physical properties are correctly acquired by the sensor. Thus, it is advantageous to be able to achieve the object to provide a coin separating and detecting device having decreased height and enabling accurate detection by a sensor.

The second aspect has a basic configuration which is identical to that of the first aspect and can therefore achieve the object of the present invention. Furthermore, in the second aspect, the detecting rotating body is formed with an inward reception peripheral edge side portion on a peripheral edge side to hold the coins fed from the separating and feeding rotating body on the detecting rotating body by the inward reception peripheral edge side portion. Accordingly, it is advantageous to be able to achieve a simple configuration at low cost since vibrations of the coins can be stopped by the reception peripheral edge side portion formed at the detecting rotating body.

The third aspect has a basic configuration which is identical to that of the first aspect and can therefore achieve the object of the present invention. Furthermore, in the third aspect, a falling guide body is disposed between the separating and feeding rotating body and the detecting rotating body. Therefore, it is advantageous to be able to guide the coins to the side of the detecting rotating body by the falling guide body and securely deliver the coins to the detecting rotating body even if the coins fall downwards onto the side of the separating and feeding rotating body when delivered from the separating and feeding rotating body to the detecting rotating body.

The fourth aspect has a basic configuration which is identical to that of the third aspect and can therefore achieve the object of the present invention. Furthermore, in the fourth aspect, the falling guide body is a slope which descends forward from the side of the separating and feeding rotating body to the side of the detecting rotating body. Therefore, it is advantageous to be able to guide the coins to the side of the detecting rotating body by the slope which descends forward and securely delivers the coins to the detecting rotating body even if the coins fall downwards into random positions.

The fifth aspect has a basic configuration which is identical to that of the first aspect and can therefore achieve the object of the present invention. Furthermore, in the fifth aspect, the detecting portion introduction guide includes an arc portion that is curved downward in the direction away from the separating and feeding rotating body, and, following the arc portion, a detection guide for a sensor extending linearly upward in the direction away from the separating and feeding rotating body, wherein the arc portion and the detection guide are connected by a temporary retaining portion which is in an arc-shape and positioned in a location lower than the arc portion and the detection guide. Thereby, the coins are delivered to the arc portion of the detecting portion introduction guide from the detecting rotating body and guided by the coin reception of the detecting rotating body with rolling being suppressed. Then, the coins arrive at the temporary retaining portion from the arc portion. The coins temporarily remain static at the temporary retaining portion without any restriction by the detecting rotating body and wait for arrival of the coin pushing portion of the detecting rotating body. During this temporary waiting, vibrations of the coins C are settled down. The temporarily waiting coins C are pushed by the coin pushing portion of the detecting rotating body, guided and moved by the linear detection guide, and pass through the sensor portion. Accordingly, the coins temporarily remain static in the step in which the coins are moved from the arc portion to the detection guide. Thus, minute vibrations are settled down during this retainment so that the coins do not spring up at the detection guide away from the detection guide. Therefore, it is advantageous to be able to acquire more accurate physical information on the coins.

DESCRIPTION OF THE PREFERRED EMBODIMENTS

Figure 1:
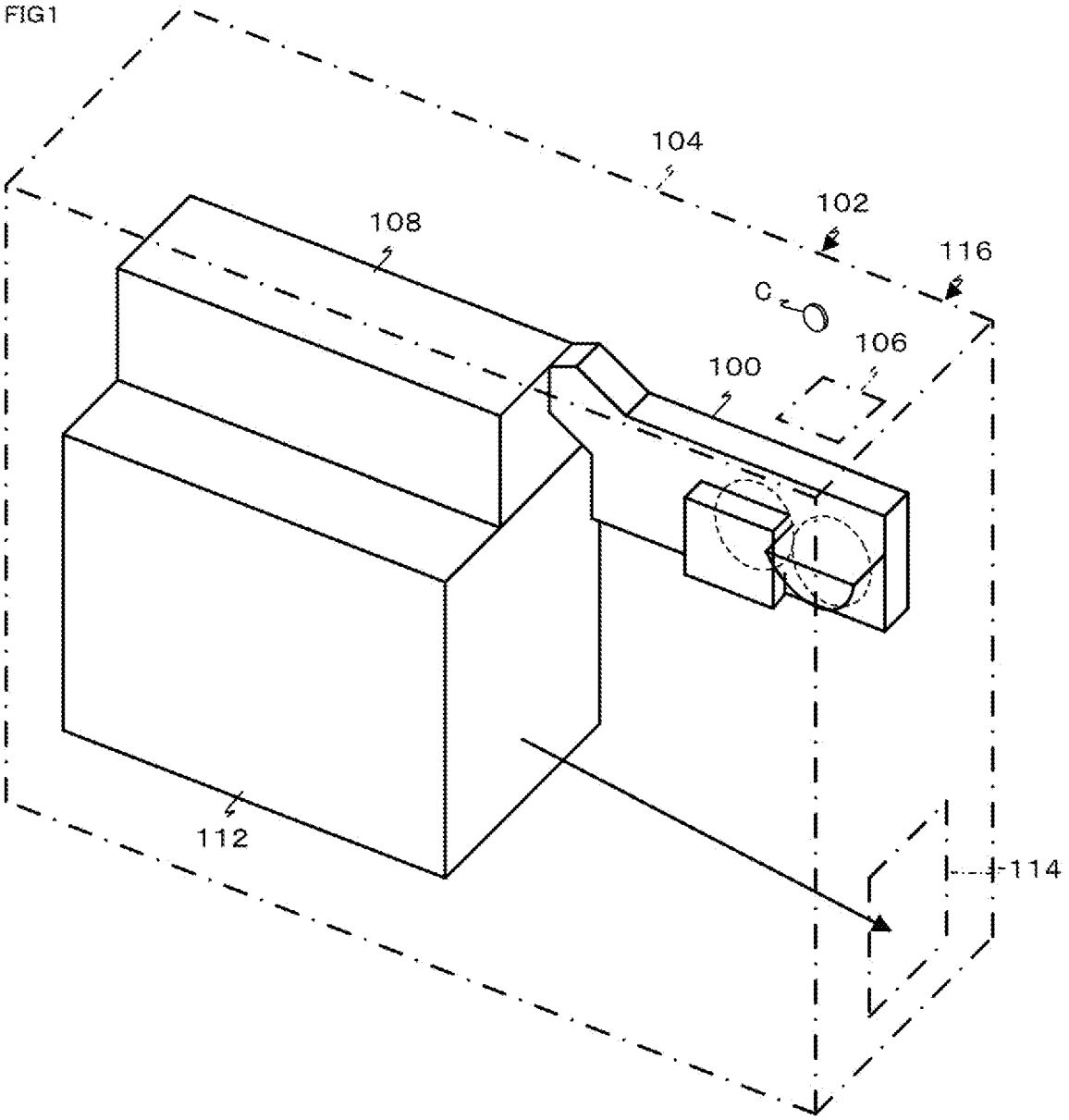
FIG. 1 is a perspective view showing an outline of a coin processing device in which a coin separating and detecting device according to the first embodiment of the present invention is installed.

The preferred embodiment of the present invention is:

A coin separating and detecting device in which coins are received one by one in a separating concave portion which is formed on an upper surface of a separating and feeding rotating body disposed inclinedly and the coins are separated, and, subsequently, the coins that have been separated are fed to a coin detecting device from a coin separating and feeding device configured to push out the coins that have been separated from the separating concave portion by a moving body which is movable in the radial direction of the separating and feeding rotating body, and the coin detecting device includes a detecting rotating body that moves the coins that have been fed along a detecting portion introduction guide, and a sensor that acquires physical information on the coins in the step in which the coins are moved along a detection guide following the detecting portion introduction guide, wherein the separating and feeding rotating body and the detecting rotating body are aligned laterally in parallel in the horizontal direction, and the detecting rotating body receives the coins in the step in which the coins fed from the separating and feeding rotating body fall downwards and holds the coins, and, thereafter, delivers the coins onto the detecting portion introduction guide, and afterwards pushes the coins forward along the detecting portion introduction guide.

It is preferable that the detecting rotating body is formed with an inward reception peripheral edge side portion on a peripheral edge side to hold the coins fed from the separating and feeding rotating body on the detecting rotating body by the inward reception peripheral edge side portion until the detecting rotating body arrives at a predetermined positional relationship.

Also, it is preferable that a falling guide body is disposed between the separating and feeding rotating body and the detecting rotating body.

Furthermore, it is preferable that the falling guide body is a slope which descends forward from the side of the separating and feeding rotating body to the side of the detecting rotating body.

Additionally, it is also preferable that the detecting portion introduction guide includes an arc portion that is curved downward in the direction away from the separating and feeding rotating body, and, following the arc portion, a detection guide extending linearly upward in the direction away from the separating and feeding rotating body wherein the sensor is disposed facing the detection guide.

Moreover, it is preferable that the detecting portion introduction guide includes an arc portion that is curved downward in the direction away from the separating and feeding rotating body, and, following the arc portion, a detection guide for the sensor extending linearly upward in the direction away from the separating and feeding rotating body wherein the arc portion and the detection guide form an arc-shaped temporary retaining portion positioned lower than the arc portion and the detection guide.

Primary Embodiment

The coin separating and detecting device 100 according to a primary embodiment or a first embodiment will now be described with reference to FIGS. 1 to 11.

The coin separating and detecting device 100 according to the present first embodiment has a function to separate a plurality of coins C one by one that have been randomly received and, thereafter, to detect physical information related to denomination identification of each coin C. The coin separating and detecting device 100 according to the present first embodiment is used, for example, in banks, shops, etc., as a cash dispenser for coins C in order to deposit the coins C and identify the denomination independently or in combination with a cash dispenser for bills and a credit/debit card processor, etc., so that the coin separating and detecting device 100 according to the present first embodiment can be applied to a coin processing device 102 in which the coins C that have been received are accepted as a disbursement. As illustrated in FIG. 1, the coin separating and detecting device 100 according to the present first embodiment is disposed within a box-shaped casing 104 and is installed in a coin dispensing device 116 configured to receive coins C that have entered the coin entry port 106 and separate the coins to individual coins C and, thereafter, acquire physical information on the coins C that have been separated to identify the denomination, sort the coins by the device 108 for sorting coins according to coin denominations, retain the coins in the device 112 for retaining coins according to coin denominations, and feed a predetermined number of coins C of a predetermined denomination from the device 112 for retaining coins according to coin denominations. Based upon receiving a command, the device 112 dispenses the coins C and the coins C are moved to the coin receiving port 114. For the coins C, coins in circulation around the world such as Japanese coins, American coins, Euro coins, etc. can be handled.

Figure 2:
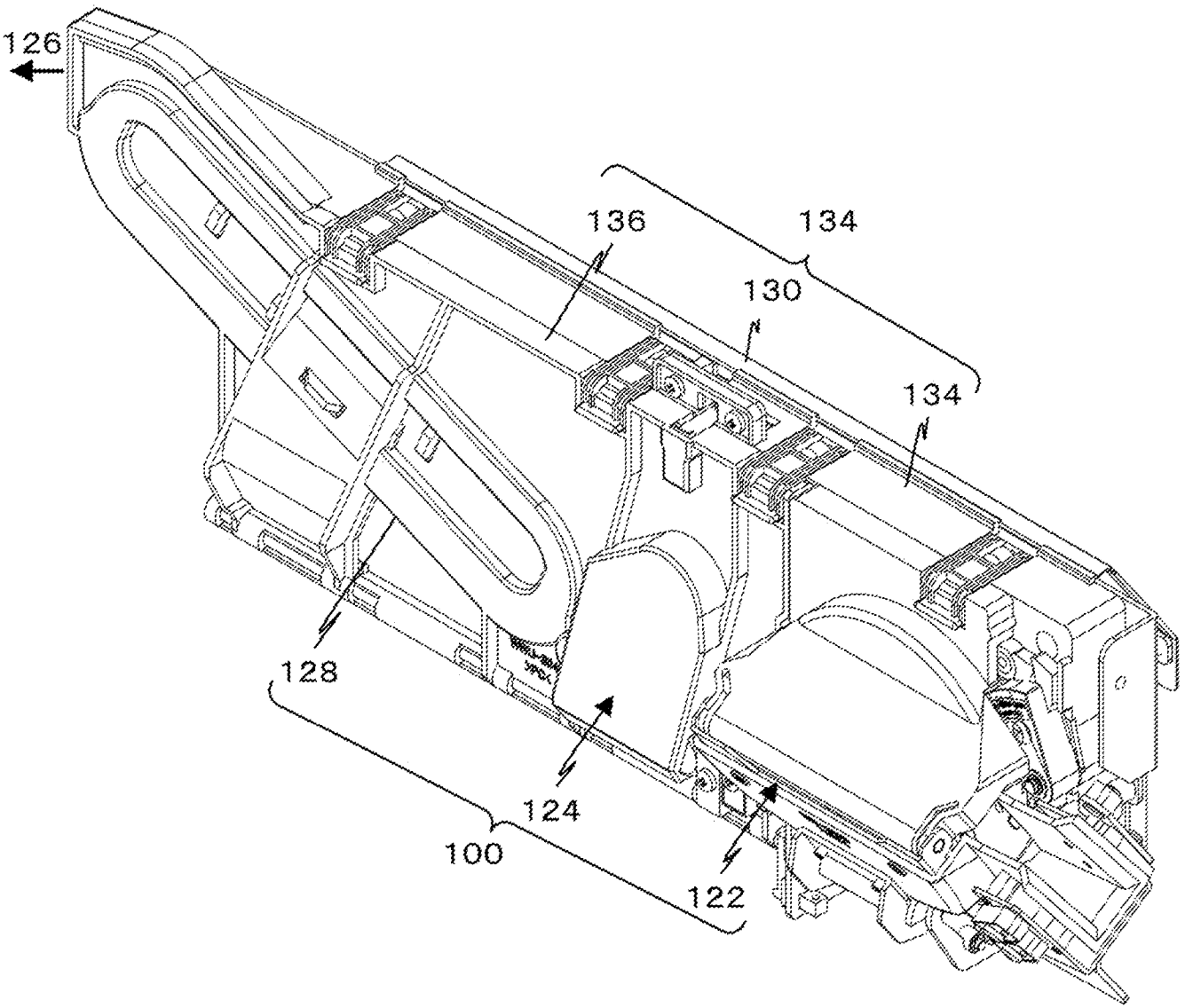
FIG. 2 is a perspective view from the upper right showing the coin separating and detecting device according to the first embodiment of the present invention.

Next, the configuration of the coin separating and detecting device 100 will be described mainly with reference to FIG. 2.

Figure 4:
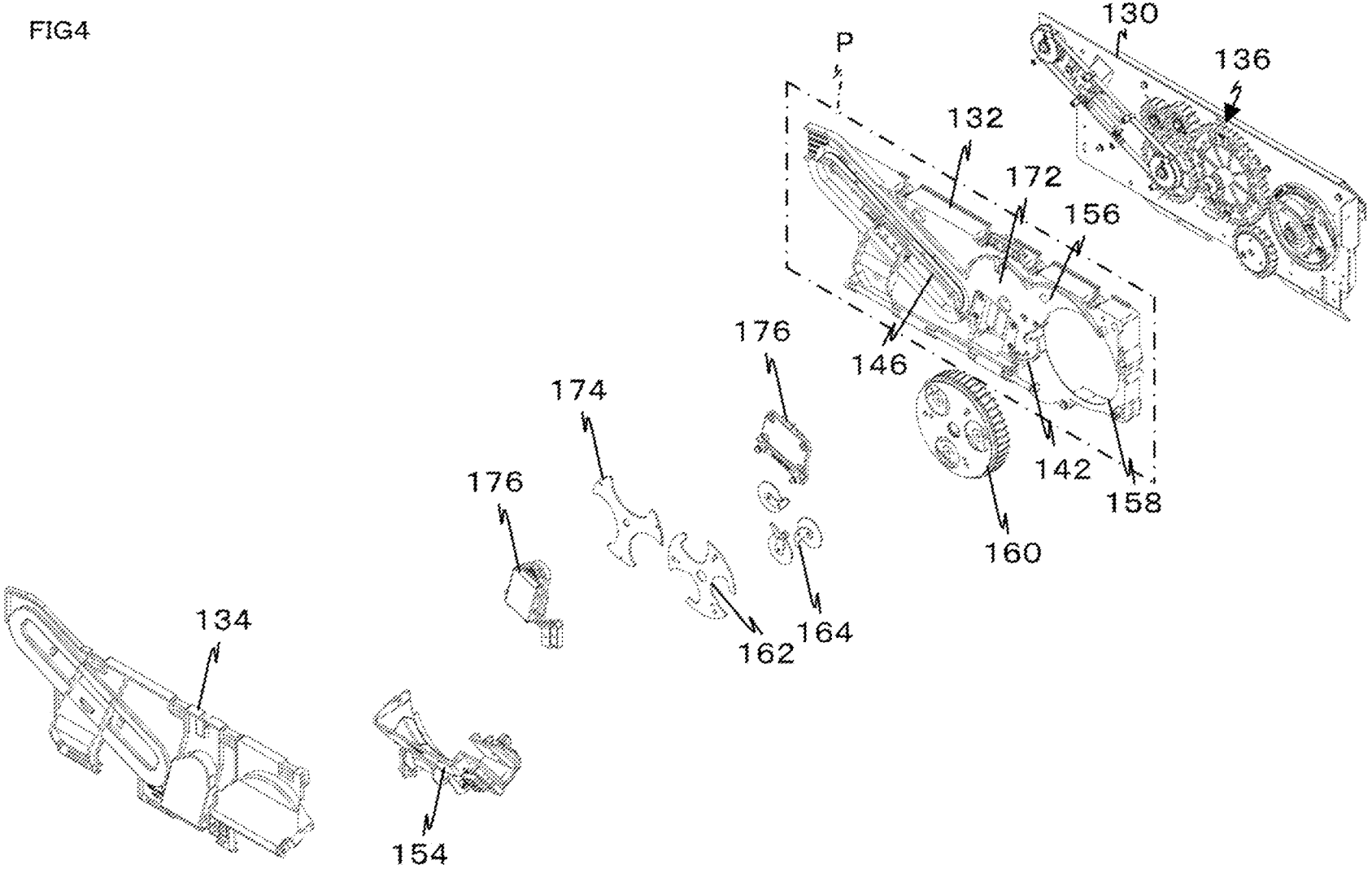
FIG. 4 is an exploded perspective view showing the coin separating and detecting device according to the first embodiment of the present invention.

The coin separating and detecting device 100 according to the first embodiment includes at least a coin separating and feeding device 122 and a coin detecting device 124 which acquires physical information used to determine authenticity and identify the denominations of the coins C. In the present first embodiment, the coin separating and detecting device 100 is further provided with a coin transport device 128 in order to transport the coins received from the coin detecting device 124 to the device 108 for sorting coins according to coin denominations as the next process 126. The coin separating and feeding device 122, the coin detecting device 124 and the coin transport device 128 are configured by a same base plate 130, a body 132 and a cover 134. Namely, as illustrated in FIG. 4, a drive mechanism 136 for the coin separating and feeding device 122, the coin detecting device 124 and the coin transport device 128 are mounted on the base plate 130 which is essentially in an oblong rectangular shape. The body 132 having a shape of an oblong rectangular thick plate, which is similar to the base plate 130, and having a cavity inside accommodates the drive mechanism 136 in the cavity and has a separating and feeding guide 138 for the coins C at the coin separating and feeding device 122 at the right end, a detecting portion introduction guide 142 for the coins C at the coin detecting device 124 in the center and a transport guide 146 for the coins C at the coin transport device 128 at the left end.

Figure 3:
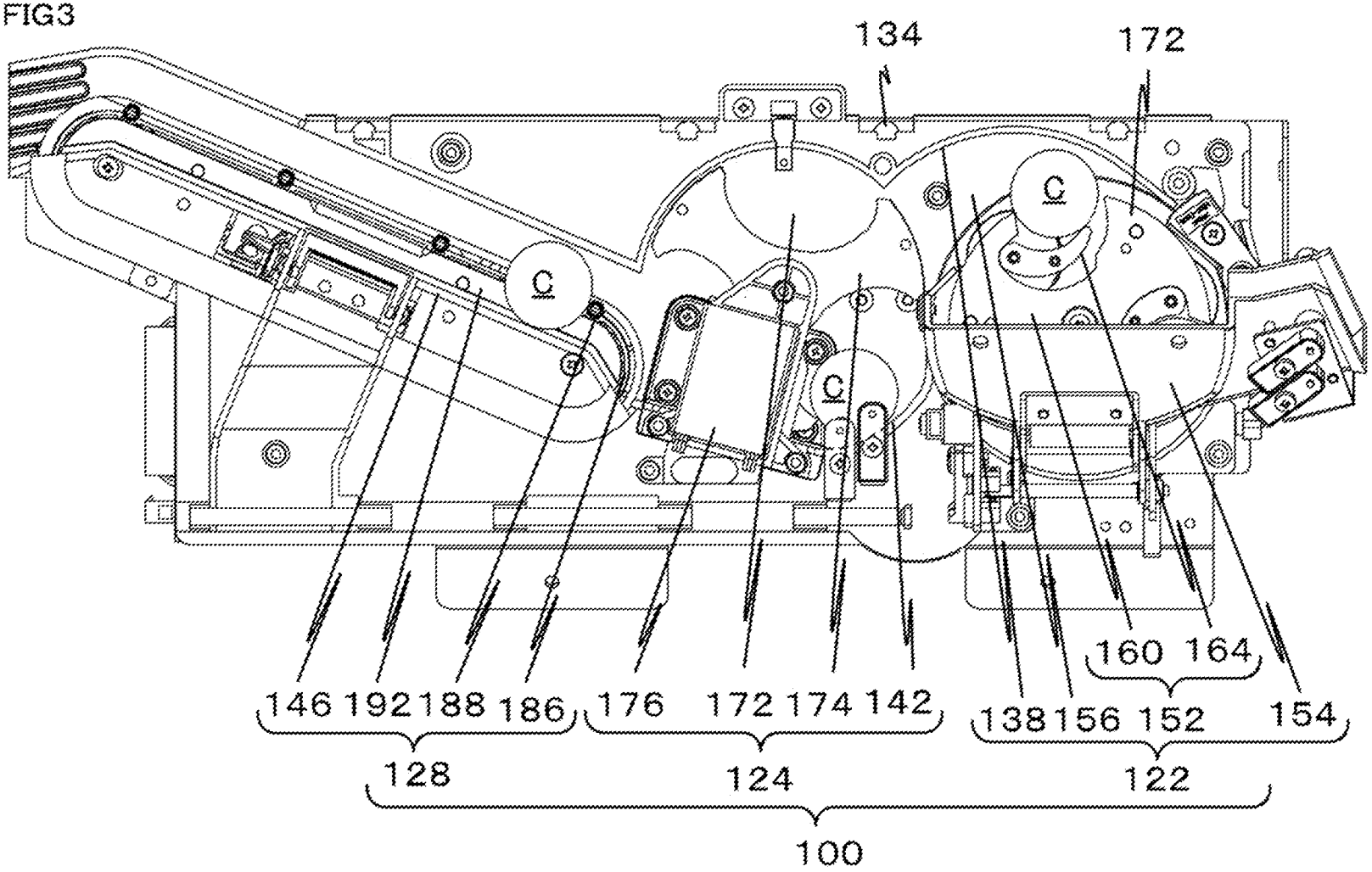
FIG. 3 is a front view showing the coin separating and detecting device according to the first embodiment of the present invention in a state in which the cover is removed.

First, the coin separating and feeding device 122 will be described mainly with reference to FIG. 3.

The coin separating and feeding device 122 has a function to separate coins C with different diameters and different denominations which are randomly retained one by one and to feed the coins to the coin detecting device 124 as the next process. The coin separating and feeding device 122 according to the present first embodiment is disposed under the coin entry port 106 and includes at least a separating and feeding rotating body 152, a coin retaining container 154, a separating slide base 156 and a separating and feeding guide 138.

Next, the separating and feeding rotating body 152 will be described.

The separating and feeding rotating body 152 has a function to separate coins C with different diameters and different denominations which are randomly retained one by one and to feed the coins to the coin detecting device 124 as the next process. The separating and feeding rotating body 152 according to the present first embodiment includes a rotating disk 160, which is rotatably provided in the circular hole 158 formed at the right end of the body 132, and a moving body 164.

First, the rotating disk 160 will be described.

The rotating disk 160 has a separating concave portion 166 on the upper surface which accepts coins C one by one, is disposed inclinedly at a predetermined angle and is rotated at a predetermined speed by a separating and rotating shaft 170 in the counter-clockwise direction.

The concave portion 166 is configured by fixing a Y-shaped plate formed with three equidistant concave portions 168 on the upper surface of the rotating disk 160 concentrically with the rotating disk 160, wherein the bottom surface is disposed within a virtual plane vp which is inclined at a predetermined angle. Accordingly, the rotating disk 160 is inclined upward at a predetermined angle. Note that it is sufficient to provide one or more concave portions 166. However, the number is set appropriately in consideration of coin separating ability per unit of time and size of the device.

Next, the moving body 164 will be described.

An arc-shaped moving body 164 which pivots about the support shaft as the fulcrum is disposed on the side of the separating and rotating shaft 170 of the concave portion 168. The concave portion 168 and the moving body 164 form the separating concave portion 166 which is open semioval on the upper surface side and open oblong on the peripheral surface side.

The size of the separating concave portions 166 is set such that two coins having the smallest diameter which are laterally aligned cannot be accepted and only one coin having the largest diameter can be accepted.

The moving body 164 is generally positioned at a location in the concave portion 168 nearer to the side of the separating and rotating shaft 170 in a static state such that the separating concave portions 166 are formed and feeds the coins C held in the separating concave portions 166 into the radial direction of the rotating disk 160 if the moving body 164 performs a pivot movement at a predetermined timing and is moved to a predetermined position.

Next, the coin retaining container 154 will be described.

The coin retaining container 154 faces the front of the lower portion of the rotating disk 160 and contacts, at the end of the semicircular shape, the body 132 adjacent to the circular hole 158 and has a function to retain and to guide a plurality of coins C to orient to the side of the rotating disk 160 in collaboration with the rotating disk 160. According to the present first embodiment, the coin retaining container 154 is formed in such a semi-bowl shape that the upper end is pivotably supported. It is preferable that the coin retaining container 154 is moved in a pivoting manner after the coins C have been processed and drops contaminants existing between the coin retaining container 154 and the rotating disk 160 downward.

Next, the separating slide base 156 will be described.

The separating slide base 156 has a function to guide the coins C in sliding contact with the lower surface of the separating concave portion 166 when the coins separated one by one and retained in the separating concave portion 166 of the separating feeding rotating body 152 are delivered to the coin detecting device 124 as the next process. According to the present first embodiment, the separating slide base 156 is a plane flush with the bottom surface of the separating concave portion 166 at the side of the coin detecting device 124 on the upper side of the circular hole 158. In other words, the separating slide base 156 is disposed within a virtual plane vp which is inclined at a predetermined angle. Thereby, the coins C pushed out of the separating concave portion 166 by the moving body 164 are moved to the side of the coin detecting device 124 while the lower surface of the coins slides and is guided on the separating slide base 156.

Next, the separating and feeding guide 138 will be described.

The separating and feeding guide 138 has a function to guide the coins C moved by the separating and feeding rotating body 152 not to deviate from the predetermined passage. According to the present first embodiment, the separating and feeding guide 138 stands up vertically from the separating slide base 156 above the circular hole 158 and is formed in an arc shape in the front view. Thereby, since the peripheral edge of the coins C is guided by the separating and feeding guide 138, the coins C moved along the separating slide base 156 are securely guided to the side of the coin detecting device 124.

Figure 7:
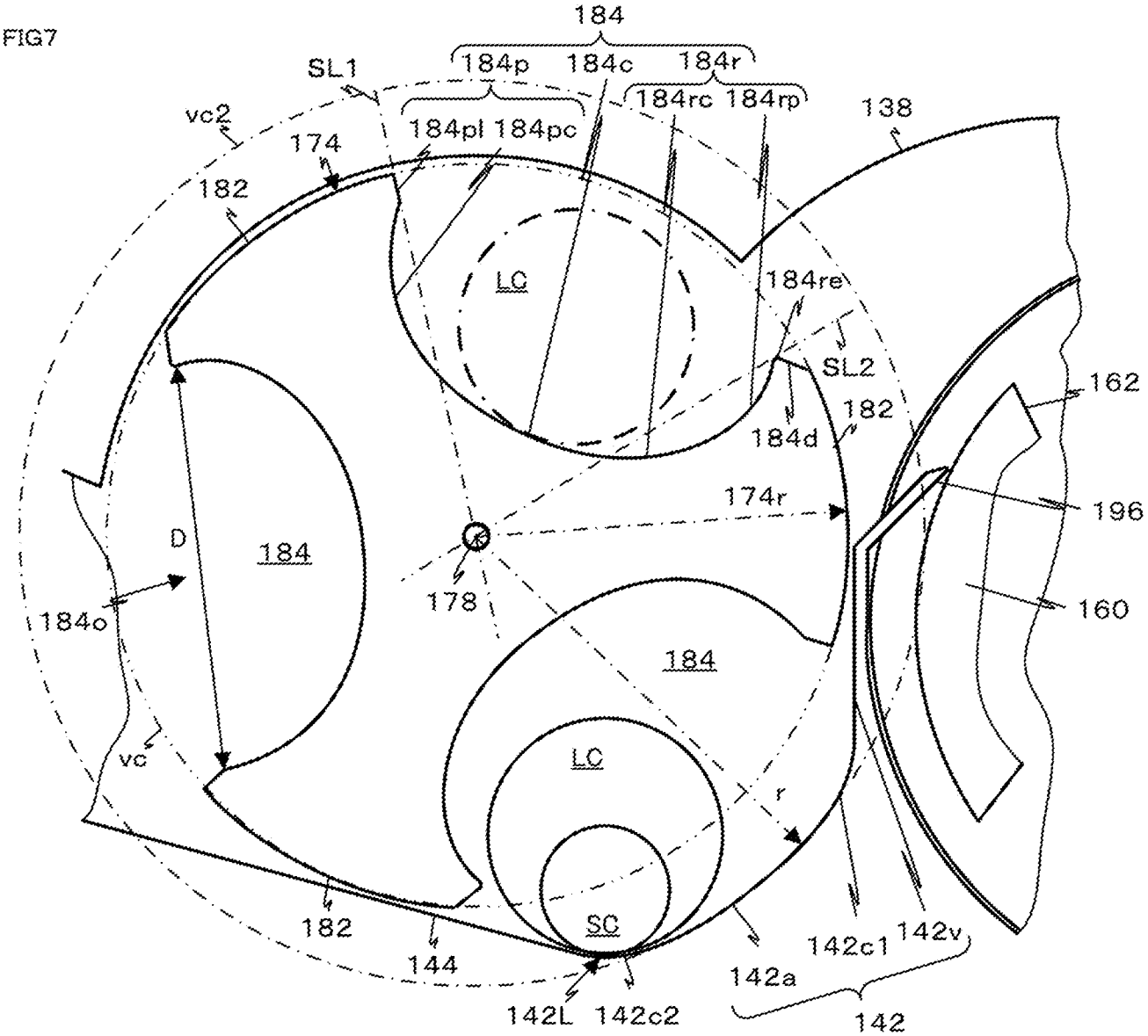
FIG. 7 is a magnification view explaining a detecting and rotating body section of the coin separating and detecting device according to the first embodiment of the present invention in a state in which coins are temporarily positioned at a temporary retaining portion.
Figure 8:
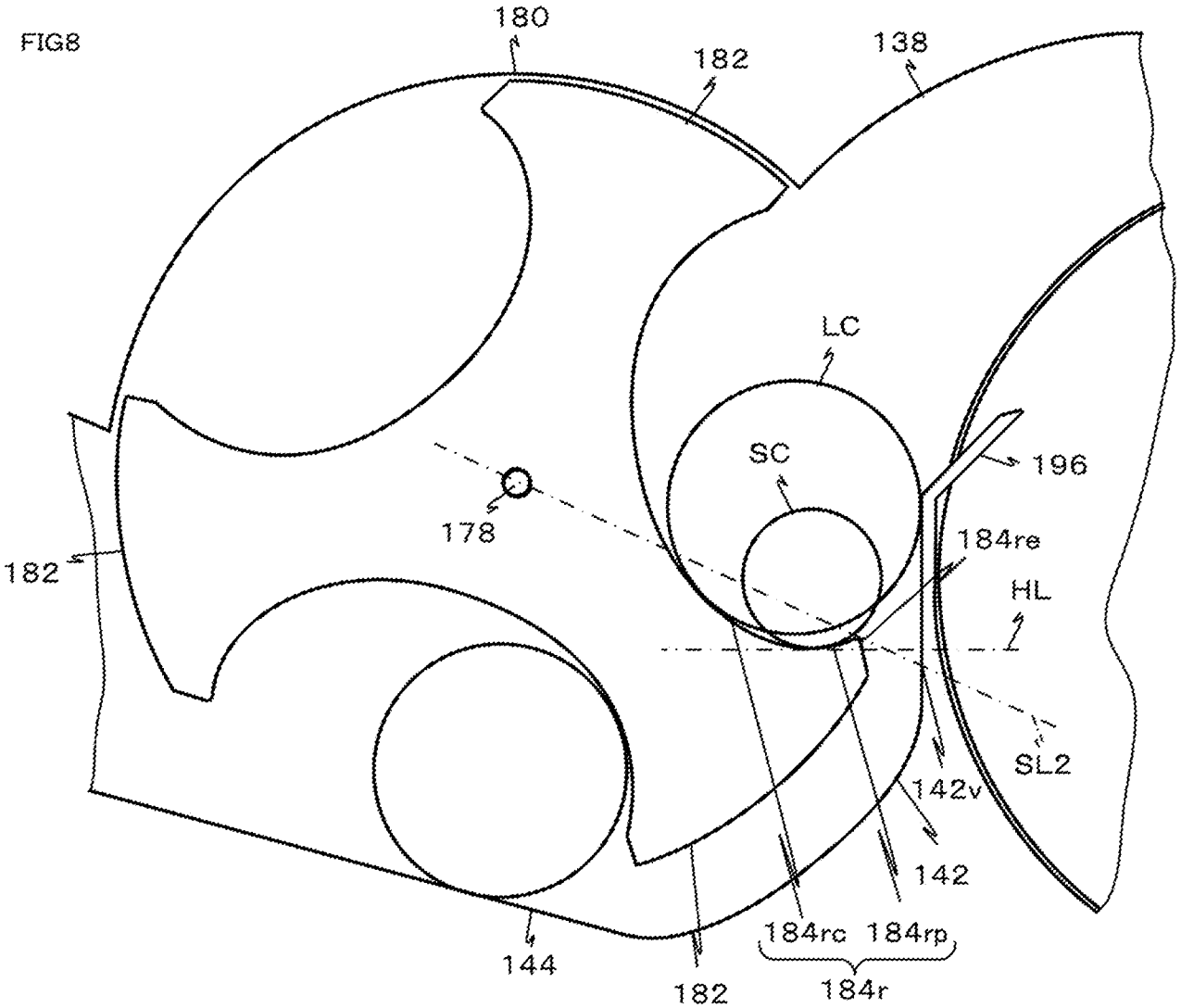
FIG. 8 is a magnification view explaining the detecting and rotating body section of the coin separating and detecting device according to the first embodiment of the present invention in a state immediately after the coins are received by a coin handling concave portion.

Next, the coin detecting device 124 will be described mainly with reference to FIGS. 7 to 9.

The coin detecting device 124 has a function to acquire information on material properties or physical information such as information on surface designs of the coins C fed by the coin separating and feeding device 122 by the sensor 176. The acquired physical information is used to determine authenticity and identify denomination. According to the present first embodiment, the coin detecting device 124 includes a detecting slide base 172, which is disposed within a plane flush with the upper surface of the rotating disk 160, namely, disposed within a virtual plane vp. The coin detecting device 124 further includes a detecting rotating body 174 for moving the coins C after receiving the coins C from the coin separating and feeding device 122, a sensor 176, and a detecting portion introduction guide 142.

Next, the detecting slide base 172 will be described.

The detecting slide base 172 has a function to guide the coins C in surface contact with the lower surface of the coins C at the coin detecting device 124, particularly, a function to guide one surface of the coins C pushed by the detecting rotating body 174. According to the present first embodiment, the detecting slide base 172 is disposed within a virtual plane vp flush with the separating slide base 156 and the coins C fed by the separating and feeding rotating body 152 of the coin separating and feeding device 122 are guided to the detecting slide base 172.

Next, the detecting rotating body 174 will be described.

The detecting rotating body 174 has a function to move the coins C received from the coin separating and feeding device 122 and to advance through the coins C one by one through the sensor 176.

Furthermore, the detecting rotating body 174 has a function to deliver the coins C advanced through the sensor 176 to the coin transport device 128.

Figure 5:
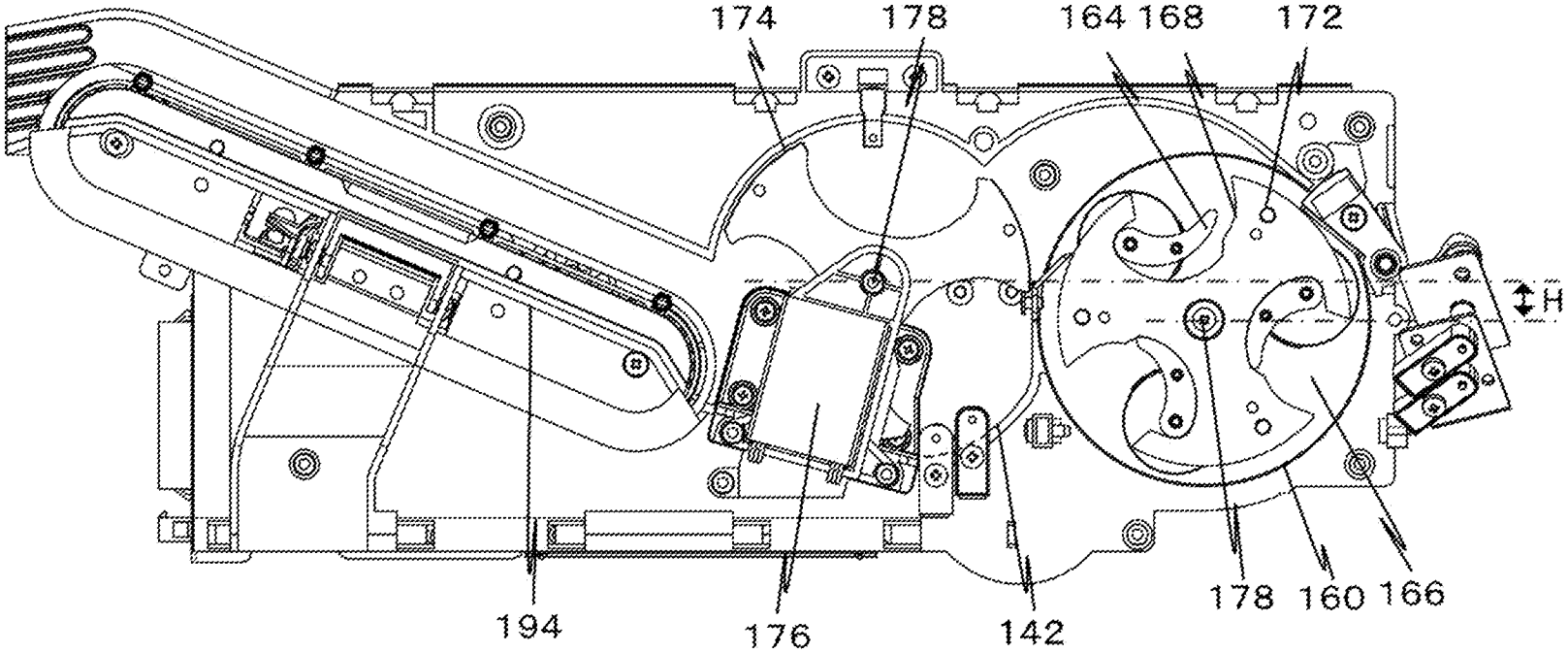
FIG. 5 is a front view showing the coin separating and detecting device according to the first embodiment of the present invention in a state in which the cover is detached.
Figure 6:
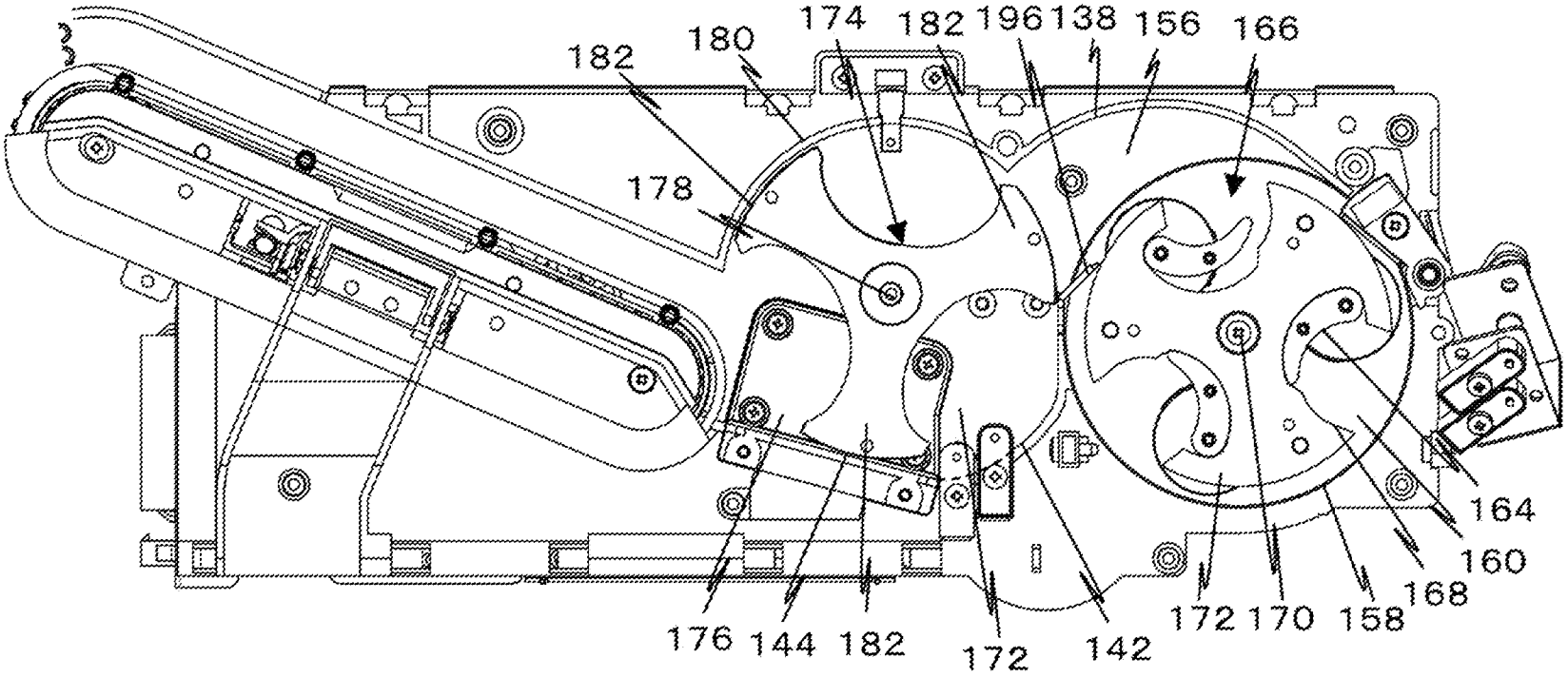
FIG. 6 is a front view showing the coin separating and detecting device according to the first embodiment of the present invention in a state in which the cover and/or the sensor are/is detached.

According to the present first embodiment, the detecting rotating body 174 is formed in a Y-shape by three, as the same number as the separating concave portions 166, coin handling arms 182 which are parallel to the slide base, are rotated about the detecting and rotating shaft 178 in the clockwise direction which is opposite to the rotational direction of the rotating disk 160 within a proximate plane interlocking with the rotating disk 160 and are disposed equidistantly. The pair of adjacent coin handling arms 182 forms three semioval coin handling concave portions 184. All of the three coin handling concave portions 184 has a same shape and will therefore be described without any discrimination. The coin handling concave portions 184 are provided corresponding to the number of the separating concave portions 166 of the coin separating and feeding device 122 and are rotated keeping a certain phase relationship with the separating concave portions 166. The coin handling concave portions 184 are formed in a semioval shape by a coin reception **184*r* configured by a trailing edge of the rotational direction of the coin handling arm 182 which is in a leading position of the rotational direction of the detecting rotating body 174, a coin pushing portion 184***p* configured by a leading edge of the rotational direction of the coin handling arm 182 which is in a trailing position of the rotational direction, and a connection edge 184*c* configured to connect the coin reception 184*r* and the coin pushing portion 184*p*. Accordingly, the coin handling concave portion 184 is a concave portion of which upper surface side and peripheral surface side are open. The peripheral surface side port 184*o* of the coin handling concave portion 184 corresponds approximately to the long-axis diameter section of the oval shape. As illustrated in FIG. 5, the center of the detecting and rotating shaft 178 of the detecting rotating body 174 and the center of the separating and rotating shaft 170 are disposed such that the center of the detecting and rotating shaft 178 is higher by the height H in the front view. The height H is set approximately corresponding to the radius of the coin having the largest diameter that will be used. The difference in this height H decreases the difference in height when the coins C are fed from the coin separating and feeding device 122 to the coin detecting device 124 and fall downward onto the coin reception 184*r* of the coin handling arm 184 so as to reduce the distance of spring-up of the coins C.

Next, the coin pushing portion 184*p* will be described.

The coin pushing portion 184*p* has a function to push forward the coins C along the detection guide 144. According to the present first embodiment, the coin pushing portion 184*p* is formed in an arc shape by a pushing arc-shaped portion 184*pc* formed on the side of the detecting and rotating shaft 178 of the coin handling arm 182 and a pushing straight line portion 184*p*1 formed at the peripheral edge side. The pushing arc-shaped portion 184*pc* has a curvature which is larger than that of the coins C having the largest diameter that will be handled. The pushing straight line portion 184*p*1 is disposed on the first straight line SL1 crossing the center of the detecting and rotating shaft 178. The pushing straight line portion 184*p*1 is disposed on the straight line SL so as not to impart any force to float from the detection guide 144 to the coins C if the coins C are moved along the detection guide 144. The pushing arc-shaped portion 184*pc* is configured by denting toward the rotational trailing side in the peripheral direction more than the first straight line SL1. Thereby, the pushing arc-shaped portion 184*pc* is configured such that the coins are pushed onto the side of the detection guide 144 and moved forward by the pushing arc-shaped portion 184*pc* at least at the initial stage in which the coins C are pushed forward along the detection guide 144.

Next, the coin reception 184*r* will be described.

The coin reception 184*r* has a function to receive the coins C fed and falling from the coin separating and feeding device 122 and to settle down the vibrations at an early stage. According to the present first embodiment, the coin reception 184*r* has a curvature which is larger than that of the coins C having the largest diameter that will be handled, and is formed by denting toward the rotational leading side more than the second straight line SL2 which connects a peripheral edge side end 184*re* of the coin reception 184*r* and the center of the detecting and rotating shaft 178. In other words, the coin reception 184*r* is configured by a reception peripheral edge side portion 184*rp* and a reception center side portion 184*rc*. The reception peripheral edge side portion 184*rp* and the reception center side portion 184*rc* which configure the coin reception 184*r* configure arc-shaped surfaces facing each other. Accordingly, as illustrated in FIG. 10(B), in case the second straight line SL2 is generally horizontal, the coin reception 184*r* presents an arc-shaped surface with the central portion denting downward. As illustrated in FIG. 8, even if the second straight line SL2 is inclined about 30°, the peripheral edge side end 184*re* is positioned above the horizon HL passing through the lowermost portion of the coin reception 184*r* and the reception peripheral edge side portion 184*rp* of the coin reception 184*r* is oriented to the side of the detecting and rotating shaft 178 of the detecting rotating body 174. In other words, since the reception peripheral edge side portion 184*rp* has an inward peripheral edge, the small-diameter coins SC put on the coin reception 184*r* are rested on the detecting rotating body 174 by the reception peripheral edge side portion 184*rp*. As illustrated in FIG. 9, since the peripheral edge side end 184*re* is positioned on the horizon HL in the state in which the second straight line SL2 is inclined about 45°, the coins C, together with the reception peripheral edge side portion 184*rp* becoming an outward inclined surface, can roll in the radial direction from the coin handling concave portion 184 with respect to the detecting rotating body 174.

Next, the connection edge 184*c* will be described.

The connection edge 184*c* has a function to connect the coin pushing portion 184*p* and the coin reception 184*r* and is formed in a concave shape toward the side of the detecting and rotating shaft 178 with a curvature which is larger than that of the coin pushing portion 184*p* and the coin reception 184*r*. In other words, the connection edge 184*c* is formed such that the curvature gradually becomes smaller from the reception center side portion 184*rc* formed from the connection edge 184*c* to the peripheral edge side end 184*re* to the reception peripheral edge side portion 184*rp*. In more detail, the reception peripheral edge side portion 184*rp* is formed in a manner of an involute curve.

The peripheral surface side port 184*o* of the coin handling concave portion 184 is defined by the pushing straight line portion 184*p*1 and the peripheral edge side end 184*re* and the distance D between both is set to about twice the diameter of the coins LC of the largest size. The depth at the bottom of the connection edge 184*c* configuring the coin handling concave portion 184 is configured, as illustrated in FIG. 7, such that the diameter of the coins LC of the largest size that will be used is only a little smaller than the virtual circle vc superposed on the peripheral edge of the detecting rotating body 174. The distance between the arc portion 142*a* which is mentioned later and the bottom of the connection edge 184*c* is set to about twice the distance to the above-mentioned virtual circle vc.

Next, the state of the coins C at the coin handling concave portion 184 will be described.

At the time when the coin handling concave portion 184 receives the coins C fed from the coin separating and feeding device 122, the second straight line SL2 is generally horizontal (FIG. 10(B)). In this state, since the coin reception 184*r* is in a concave shape with the center being dented, the coins C are stopped to be moved in the radial direction of the coin handling arm 182 by the inward reception peripheral edge side portion 184*rp*. Even if the coins C are vibrated in the radial direction of the coin handling arm 182, the rolling force is damped during rolling the short distance between the reception center side portion 184*rc* and the reception peripheral edge side portion 184*rp*.

Figure 9:
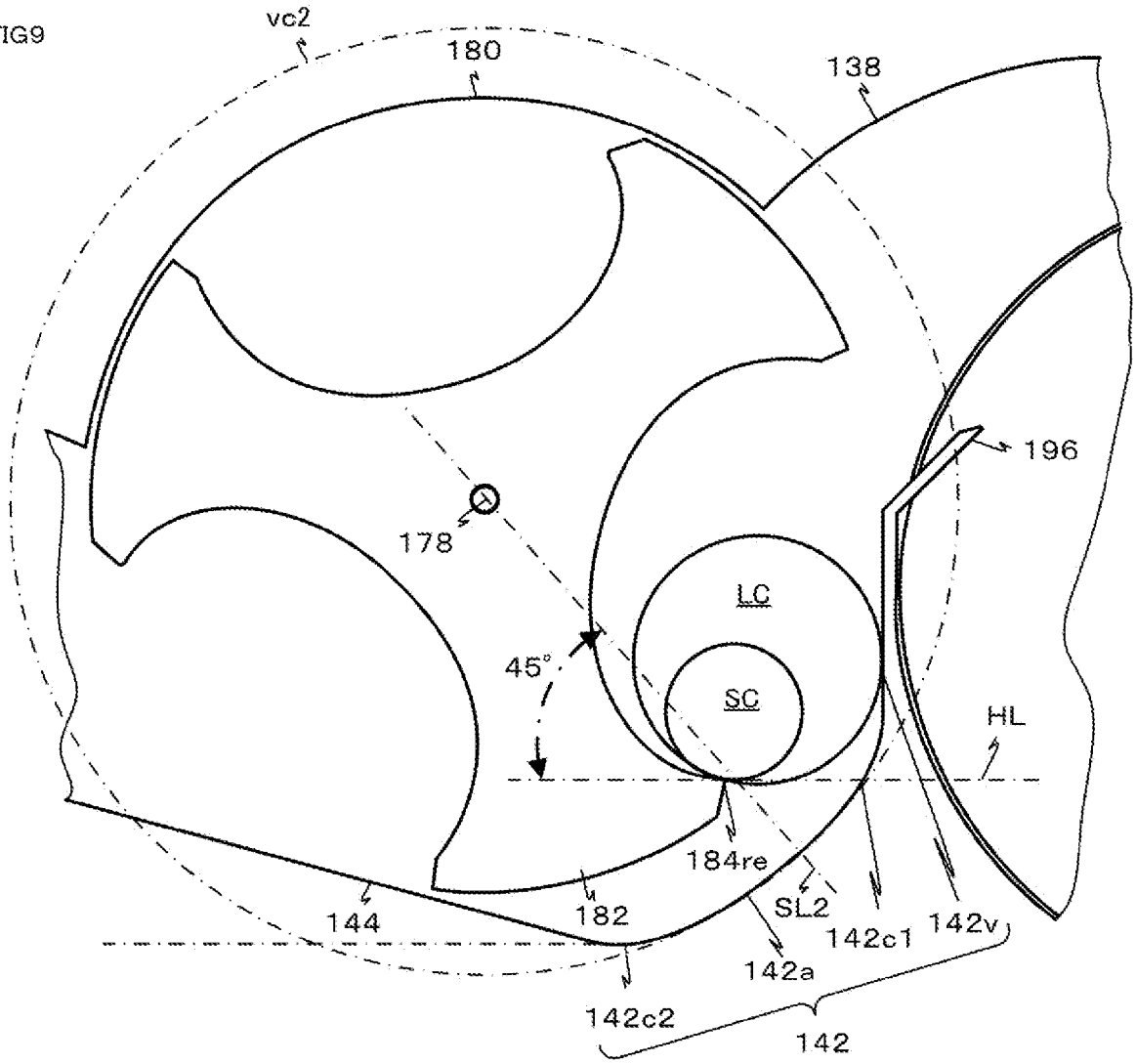
FIG. 9 is a magnification view explaining the detecting and rotating body section of the coin separating and detecting device according to the first embodiment of the present invention in a state immediately before the coins fall downward onto an arc portion.
Figure 10:
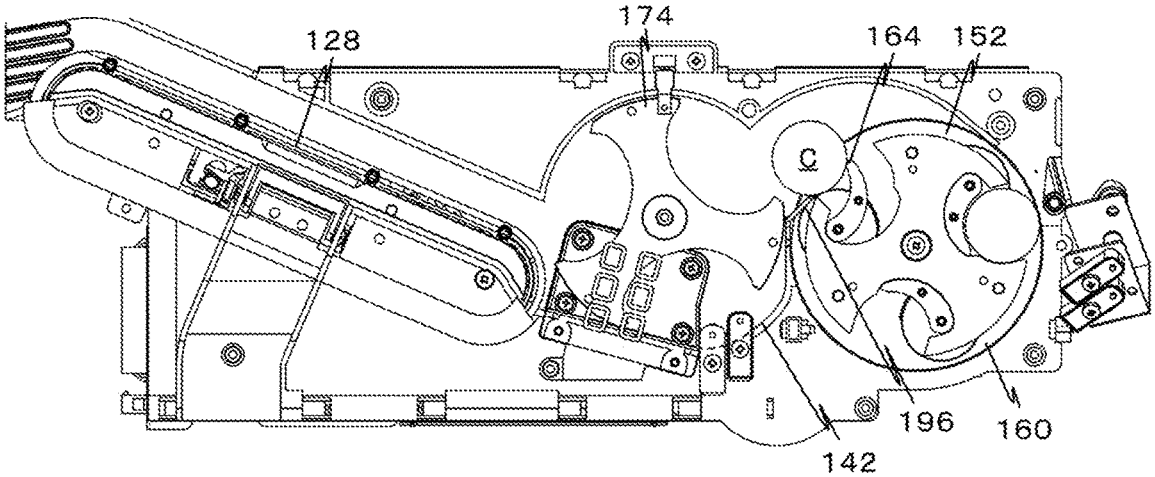
FIG. 10 is a view explaining the working of the coin separating and detecting device according to the first embodiment of the present invention.
Figure 10:
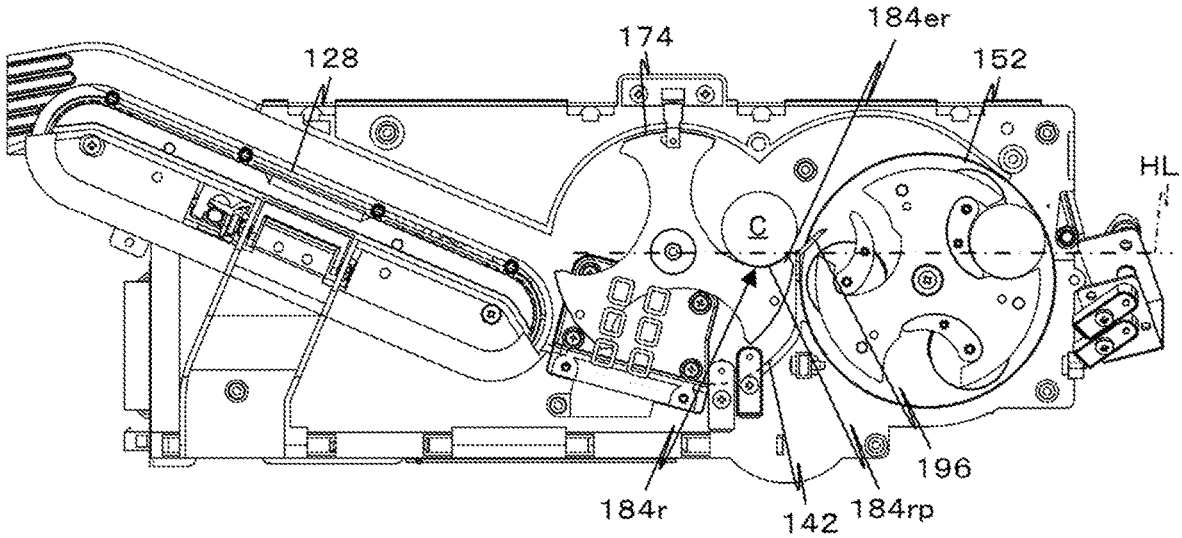
Figure 11:
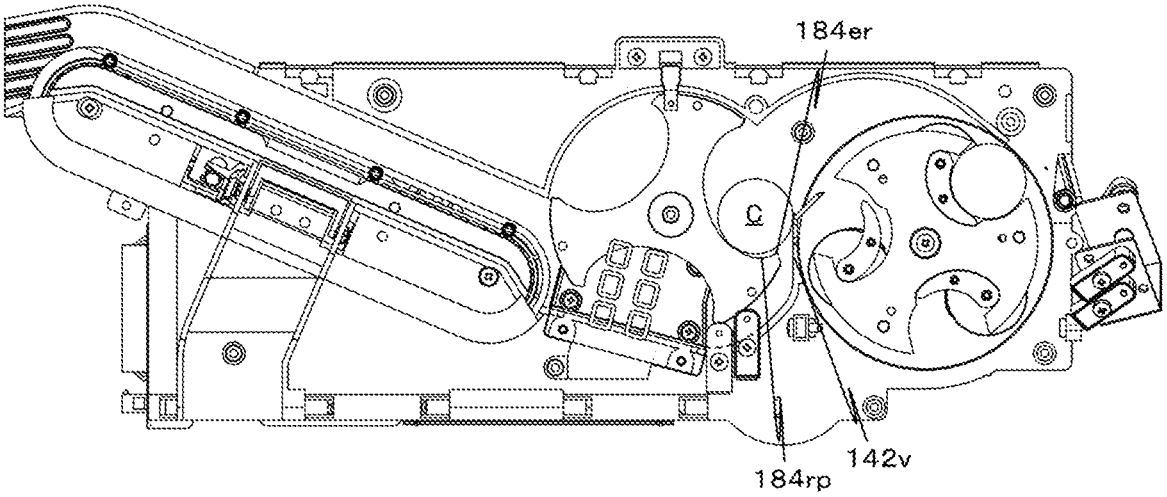
FIG. 11 is a view explaining the working of the coin separating and detecting device according to the first embodiment of the present invention.
Figure 11:
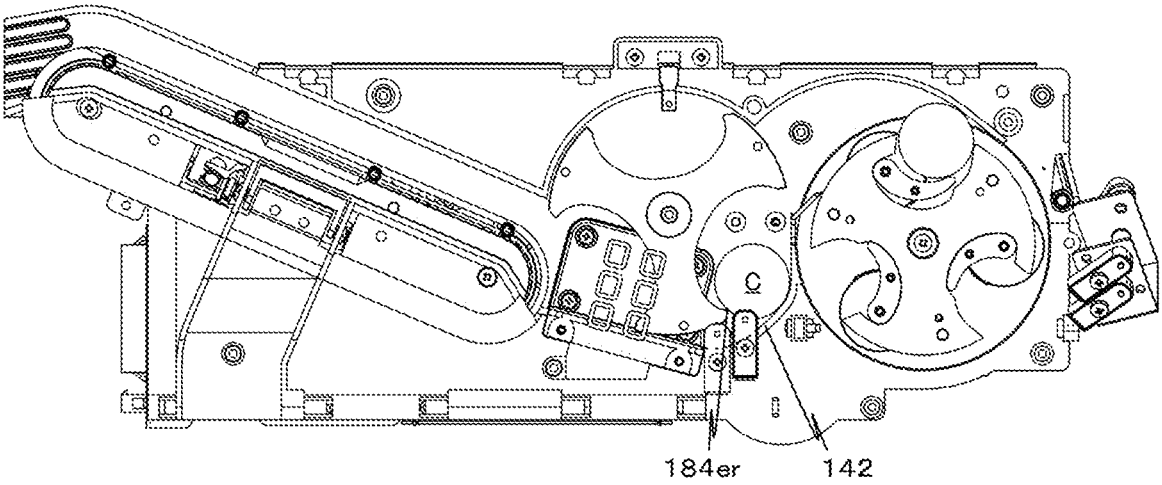
Figure 11:
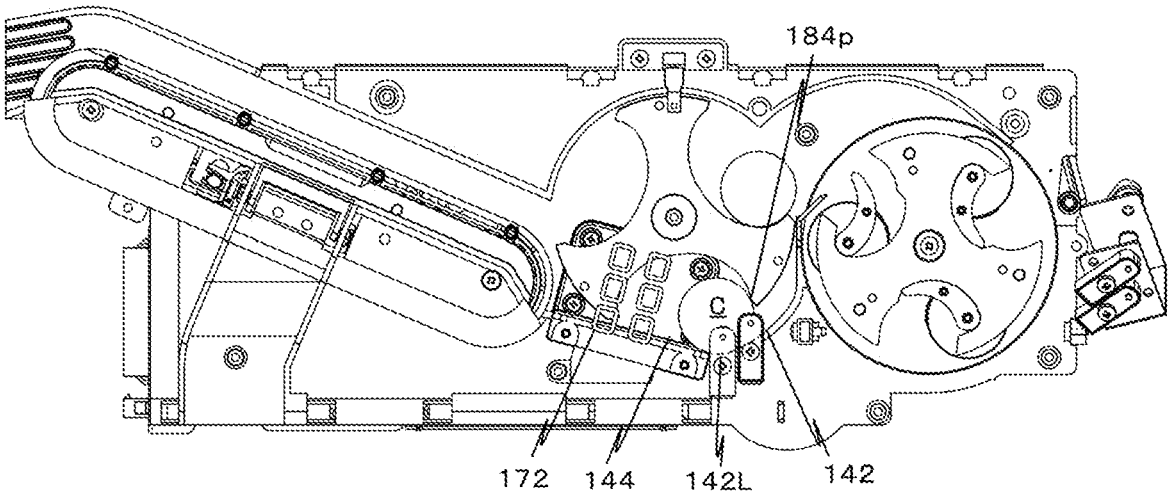
Figure 12:
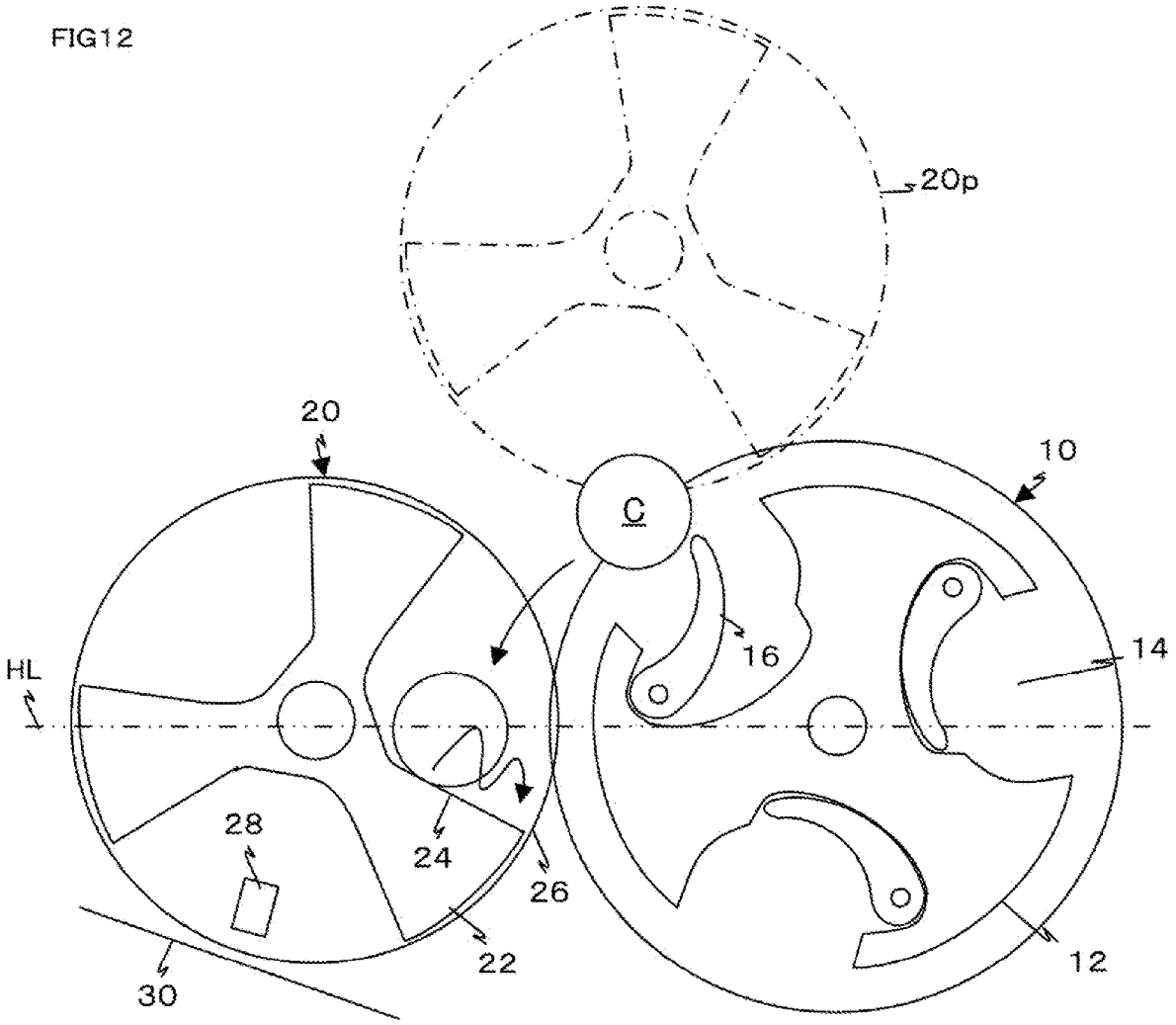
FIG. 12 is a view explaining a conventional coin separating and detecting device.

Since the peripheral edge side end 184*re* is positioned above the horizon HL until the second straight line SL2 at the coin handling arm 182 is inclined about 45° (FIG. 9, FIG. 11(B)), the coins C are put on the coin reception 184*r* (reception peripheral edge side portion 184*rp*, reception center side portion 184*rc*) and rested in the coin handling concave portion 184. Accordingly, if the coins C fall into the coin handling concave portion 184 and spring up on the coin reception 184*r*, the coins roll between the reception peripheral edge side portion 184*rp* and the reception center side portion 184*rc* and the kinetic energy is damped.

It is preferable that the outer peripheral side, which is placed further out than the peripheral edge side end 184*re*, of the coin handling arm 182 configures a detecting rotating body restraint surface 184*d* which is formed descending forward to the side of the coin separating and feeding device 122 at least in a phase facing the separating slide base 156. This is because the coins C fed from the coin separating and feeding device 122 cannot overcome until the detecting rotating body restraint surface 184*d* reaches a predetermined phase and cannot travel to the coin detecting device 124 and the timing at which the coins C are received by the coin detecting device 124 is to be equal.

Next, the detecting portion introduction guide 142 will be described.

The detecting portion introduction guide 142 has a function to guide the coins C held and moved by the coin handling arm 182 and to suppress minute vibrations of the coins C. According to the present first embodiment, the detecting portion introduction guide 142 is configured by a vertical portion 142*v* which is formed vertical downward from the side portion of the detecting rotating shaft 178, an arc portion 142*a*, following the vertical portion 142*v*, which is formed with a predetermined radius r centered to the center of the axis of the detecting rotating shaft 178, a first detecting connection 142*c*1 which connects the vertical portion 142*v* and the arc portion 142*a* smoothly, and a second detecting connection 142*c*2 which connects the arc portion 142*a* and the detection guide 144 by a smooth arc-shaped portion.

As illustrated in FIG. 9, the lower end of the vertical portion 142*v* is formed up to the position in which the peripheral surface of the coin of the largest size that will be used approximately comes to contact in the state in which the second straight line SL2 is inclined about 45° (in the state in which the peripheral edge side end 184*re* is positioned on the horizon HL). Principally, the small-sized coins SC held on the coin reception 184*r* do not contact the vertical portion 142*v*. However, as illustrated in FIG. 8, the peripheral surfaces of the large-sized coins LC are guided by the vertical portion 142*v*.

The large-sized coins LC that have been guided by the vertical portion 142*v* are smoothly guided by the first detecting connection 142*c*1 to the arc portion 142*a*. The small-sized coins SC not guided by the vertical portion 142*v* principally fall onto the arc portion 142*a*.

The arc portion 142*a* is an arc formed on the second virtual circle vc2 that is formed by a radius r which is larger than the radius 174*r* of the detecting rotating body 174 and is formed, in the front view, in the range between the position at about 45° with respect to the detecting rotating shaft 178 and the position at about 45° to an essentially lowermost position. Accordingly, all of the coins C are guided by the arc portion 142*a* to arrive at the second detecting connection 142*c*2.

The second detecting connection 142*c*2 is formed in an arc shape that connects the arc portion 142*a* and the detection guide 144 smoothly. Also, the second detecting connection 142*c*2 is configured in the lowermost position at the detecting portion introduction guide 142. Accordingly, if the coin handling arm 182 does not act on the coins C, the coins C reach a static state at the second detecting connection 142*c*2 in the lowermost position. Namely, a temporary retaining portion 142L is formed by the second detecting connection 142*c*2 directly in front of the detection guide 144. In other words, the temporary retaining portion 142L is configured between the detecting portion introduction guide 142 and the detection guide 144. Thereby, the coins C that have rolled on the detecting portion introduction guide 142 while being restricted by the peripheral edge side end 184*re* reach a temporary free state at the temporary retaining portion 142L until the coins C are then pushed by the pushing straight line portion 184*p*1. Even if the coins are vibrated during moving with the movement being suppressed by the peripheral edge side end 184*re*, the vibrations are settled down in this free state to reach a static state.

Next, the detection guide 144 will be described.

The detection guide 144 has a function to guide the coins C passing through a section of the sensor 176. According to the present first embodiment, the detection guide is configured linearly. Also, in order to avoid separation of the coins C from the detection guide 144, the detection guide is formed in an inclined state rising forward. The inclination angle of the detection guide 144 depends on the movement speed of the coins C but is preferably about 15° to the horizon.

Next, the sensor 176 will be described.

The sensor 176 has a function to detect physical properties of the coins C which are pushed by the coin pushing portion 184*p* of the coin handling arm 182 of the detecting rotating body 174 while being guided by the detection guide 144. According to the present first embodiment, a magnetic sensor is deployed for the sensor 176.

However, well-known sensors for coins such as image sensors, etc. can be deployed as the sensor 176.

Next, the detection guide portion 180 will be described.

The detection guide portion 180 protrudes above by a predetermined height rectangular and with respect to the detecting slide base 172 in a proximate position at the upper outer periphery of the detecting rotating body 174 so as to present an arc shape in the front view and is connected to the separating and feeding guide 138.

Next, the coin transport device 128 will be described with reference to FIG. 3.

The coin transport device 128 has a function to transport the coins C fed one by one from the coin detecting device 124 to a device 108 for sorting coins according to coin denominations as the next process 126. The coin transport device 128 according to the present first embodiment includes a push pin 188 that is fixed at an endless transport body 186 with a predetermined distance which moves in one direction away from the coin detecting device 124 within the same plane, a slide plate 192 on which one surface of the coins C pushed by the push pin 188 slides and a linear transport guide 146 that guides the peripheral surface of the coins C.

By the above configuration, the coins C which have been moved on the detection guide 144 are delivered to the coin transport device 128, the lower surface of the coins C is guided by the slide plate 192 while being pushed by the push pin 188 and the coins are moved while the lower end peripheral surface is guided by the transport guide 146 to be fed to the next process 126.

Next, the falling guide body 196 will be described.

The falling guide body 196 is disposed between the coin separating and feeding device 122 and the coin detecting device 124 and has a function to guide the coins C fed from the coin separating and feeding device 122 such that the coins C are securely delivered to the coin detecting device 124. According to the present first embodiment, the falling guide body 196 is configured by a plate-shaped body inclined descending forward to the side of the coin detecting device 124 from the upper end of the vertical portion 142*v* up to the position proximate to the separating concave portion 166 at the upper surface of the peripheral edge of the rotating disk 160. The falling guide body 196 is not limited to be plate-shaped but may be bar-shaped.

Next, the working of the present first embodiment will be described.

After coins C enter the coin entry port 106, a sensor which is not shown detects the entry, and the separating and feeding rotating body 152 and the detecting rotating body 174 rotate in an interlocking manner. The coins C that have entered fall into the coin retaining container 154. The coins C in the coin retaining container 154 are separated one by one by the rotation of the separating and feeding rotating body 152 in a state in which the coins C are in surface contact with the bottom surface of the separating concave portion 166 and are pushed out to the peripheral side of the separating and feeding rotating body 152 by the moving body 164 in approximately the 10 or 11 o'clock position of a clock (FIG. 10(A)). Thereby, the coins C fall toward the side of the coin detecting device 124 and are guided by the falling guide body 196 to arrive at the coin reception 184*r* and are held (FIG. 10(B)). Since the second straight line SL 2 is generally horizontal in this state and the reception peripheral edge side portion 184*rp* is oriented to the rotational center side of the detecting rotating body 174, the coins C do not spring out of the coin handling concave portion 184 even in case of spring-up as a reaction of having fall-down. In case of large-sized coins C, when the detecting rotating body 174 further rotates, they are held between the reception center side portion 184*rc* and the vertical portion 142*v* (FIG. 11A) and roll on the arc portion 142*a* via the first detecting connection 142*c*1 (FIG. 11(B)). In case of the small-diameter coins SC, the rolling of the coins C on the arc portion 142*a* is carried out based on the movement of the peripheral edge side end 184*re* (reception center side portion 184*rc* and reception peripheral edge side portion 184*rp*) of the coin reception 184*r* without being guided by the vertical portion 142*v*. If the second straight line SC2 becomes approximately 45°, the coins C are released from the restriction of the reception peripheral edge side portion 184*rp* and fall down onto the arc portion 142*a* to roll on it (FIG. 11(B)). The coins C roll on the arc portion 142*a* with the rolling suppressed by the reception peripheral edge side portion 184*rp*. In other words, the coins C roll on the arc portion 142*a* while being in contact with the peripheral edge side end 184*re* and arrive at the temporary retaining portion 142L as the second detecting connection 142*c*2. When the coins C arrive at the second detecting connection 142*c*2, the coins C remain static at the temporary retaining portion 142L until the coins C are pushed by the coin pushing portion 184*p*, because the detection guide 144 is inclined upward. In other words, the coins C remain static and are held at the temporary retaining portion 142L without being affected by any external force. Even if minute vibrations occur as a reaction of fall-down of the coins C, the vibrations are damped at the temporary retaining portion 142L and the coins C reach an essentially static state. After the vibrations are settled down, the coin pushing portion 184*p* starts pushing the coins C along the detection guide 144. In the step in which the coins C are moved by the coin pushing portion 184*p* along the detection guide 144, information on physical properties is acquired by the sensor 176. After passing through the detection guide 144, the coins C are pushed by the push pin 188 of the coin transport device 128, are fed to the next process 126 while being guided by the slide plate 192 and a guide rail 194.

DESCRIPTION OF SYMBOLS

C coin
122 coin separating and feeding device
124 coin detecting device
142 detecting portion introduction guide
142L temporary retaining portion
144 detection guide
152 separating and feeding rotating body
164 moving body
166 separating concave portion
174 detecting rotating body
176 sensor
184*rp* reception peripheral edge side portion
196 falling guide body

What is claimed is:

1. A coin separating and detecting device comprising:

a separating and feeding rotating body disposed inclinedly and configured to receive and separate coins, an upper surface of the separating and feeding rotating body defining a separating concave portion;

a coin separating and feeding device configured to push out the coins that have been separated from the separating concave portion by a moving body, the moving body movable in a radial direction of the separating and feeding rotating body; and a coin detecting device configured to receive the coins from the coin separating and feeding device, the coin detecting device comprising:

a detecting rotating body configured to move the coins along a detecting portion introduction guide, the separating and feeding rotating body and the detecting rotating body being positioned adjacent each other in a horizontal direction; and a sensor configured to acquire physical information on the coins in a step in which the coins are moved along a detection guide following the detecting portion introduction guide, the detection guide extending linearly upward in a direction away from the separating and feeding rotating body, wherein the detecting portion introduction guide comprises:

an arc portion:

curved downward in a direction away from the separating and feeding rotating body, and defining a predetermined radius, the predetermined radius measured from a center of an axis of the detecting rotating shaft of the detecting rotating body; and a temporary retaining portion:

connecting the arc portion and the detection guide, defining an arc shape, and positioned in a location lower than the arc portion and the detection guide, wherein the detecting rotating body is configured to receive the coins in a step in which the coins fed from the separating and feeding rotating body fall downwards; hold the coins; deliver the coins onto the detecting portion introduction guide; and push the coins forward along the detecting portion introduction guide.

2. The coin separating and detecting device according to claim 1, wherein a falling guide body is disposed between the separating and feeding rotating body and the detecting rotating body.

3. The coin separating and detecting device according to claim 1, wherein the detecting rotating body is formed with an inward reception peripheral edge side portion on a peripheral edge side to hold coins which have been fed from the separating and feeding rotating body by the inward reception peripheral edge side portion until the detecting rotating body arrives at a predetermined positional relationship.

4. The coin separating and detecting device according to claim 3, wherein a falling guide body is disposed between the separating and feeding rotating body and the detecting rotating body.

5. The coin separating and detecting device according to claim 4, wherein the falling guide body defines a slope extending downwards and forward from a side of the separating and feeding rotating body toward a side of the detecting rotating body.

* * * * *